US009567547B2

(12) United States Patent
Sumiejski et al.

(10) Patent No.: US 9,567,547 B2
(45) Date of Patent: Feb. 14, 2017

(54) CONTINUOUSLY VARIABLE TRANSMISSION FLUID WITH EXTENDED ANTI-SHUDDER DURABILITY

(75) Inventors: James L. Sumiejski, Mentor, OH (US); William D. Abraham, Concord, OH (US); Richard J. Vickerman, Stow, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 224 days.

(21) Appl. No.: 13/976,670

(22) PCT Filed: Jan. 3, 2012

(86) PCT No.: PCT/US2012/020014

§ 371 (c)(1),
(2), (4) Date: Oct. 16, 2013

(87) PCT Pub. No.: WO2012/094275

PCT Pub. Date: Jul. 12, 2012

(65) Prior Publication Data

US 2014/0031268 A1 Jan. 30, 2014

Related U.S. Application Data

(60) Provisional application No. 61/429,535, filed on Jan. 4, 2011.

(51) Int. Cl.

| | |
|---|---|
| ***C07F 5/04*** | (2006.01) |
| ***C10M 141/10*** | (2006.01) |
| ***C10M 135/02*** | (2006.01) |
| ***C07F 9/02*** | (2006.01) |
| ***C10M 141/12*** | (2006.01) |

(52) U.S. Cl.

CPC ..... *C10M 141/12* (2013.01); *C10M 2201/085* (2013.01); *C10M 2207/042* (2013.01); *C10M 2209/084* (2013.01); *C10M 2215/042* (2013.01); *C10M 2215/064* (2013.01); *C10M 2215/082* (2013.01); *C10M 2215/28* (2013.01); *C10M 2223/049* (2013.01); *C10N 2210/02* (2013.01); *C10N 2230/02* (2013.01); *C10N 2230/06* (2013.01); *C10N 2230/76* (2013.01); *C10N 2240/045* (2013.01); *C10N 2260/10* (2013.01); *C10N 2260/14* (2013.01)

(58) Field of Classification Search

CPC .. C10M 133/16; C10M 133/08; C10M 137/12
USPC ..... 508/591, 317, 335, 354, 191
See application file for complete search history.

(56) References Cited

U.S. PATENT DOCUMENTS

| | | | | |
|---|---|---|---|---|
| 7,618,929 | B2 | 11/2009 | Tipton et al. | |
| 2005/0041395 | A1 | 2/2005 | Tipton et al. | |
| 2006/0172899 | A1* | 8/2006 | Tipton et al. | 508/545 |
| 2008/0248980 | A1* | 10/2008 | Sumiejski et al. | 508/156 |
| 2009/0312207 | A1* | 12/2009 | Bartley et al. | 508/161 |

FOREIGN PATENT DOCUMENTS

| | | |
|---|---|---|
| JP | 2002-226882 | 8/2002 |
| WO | 2006/091371 | 8/2006 |
| WO | 2008/076825 | 6/2008 |

OTHER PUBLICATIONS

Pennings et al., SAE Paper 2003-01-3253, "Van Doorne CVT Fluid Test: A Test Method on Belt-Pulley Level to Select Fluids for Push Belt CVT Applications", 2003.
Japanese Automobile Standard M349, "Road vehicles-Test method for anti-shudder performance of automatic transmission fluids", 2001.
Corresponding International Publication No. WO 2012/094275 A1 & Search Report published Jul. 12, 2012.
Written Opinion of corresponding International Application No. PCT/US2012/020014 dated Apr. 17, 2012.
Wang, Rulin, "Tribochemistry of Lubrication", China Petrochemical Press, First Edition, Oct. 1994, pp. 258-259.

* cited by examiner

*Primary Examiner* — Prem C Singh
*Assistant Examiner* — Francis C Campanell
(74) *Attorney, Agent, or Firm* — David M. Shold, Esq.; Teresan W. Gilbert, Esq.

(57) ABSTRACT

A lubricant composition comprising (a) an oil of lubricating viscosity; (b) at least two nitrogen-containing materials, comprising (i) at least one amide of the formula $R^3C(O)NR^1R^2$ and (ii) at least one tertiary amine being represented by the formula $R^4R^5NR^6$ where $R^4$ and $R^5$ are alkyl groups of at least 6 carbon atoms and $R^6$ is a polyhydroxyl-containing alkyl group or a polyhydroxyl-containing alkoxyalkyl group; (c) a functionalized dispersant component, and (d) at least one diallyl phosphite, provides good lubricant performance for a continuously variable transmission.

22 Claims, No Drawings

CONTINUOUSLY VARIABLE TRANSMISSION FLUID WITH EXTENDED ANTI-SHUDDER DURABILITY

BACKGROUND OF THE INVENTION

The disclosed technology relates to a lubricant and lubricant additive for a continuously variable transmission, providing anti-shudder durability while maintaining acceptable high metal friction coefficient.

Continuously variable transmissions (CVT) represent a radical departure from conventional automatic transmissions. Since the introduction of the push belt version of the CVT, many cars have been equipped with the push belt CVT system. A more detailed description of such transmissions and belts and lubricants employed therein is found in European Patent Application 753 564, published Jan. 15, 1997. In brief, a belt and pulley system is central to the operation of this type of transmission. The pulley system comprises a pair of pulleys with a V-shaped cross-section, each consisting of a moveable sheave, a fixed sheave, and a hydraulic cylinder. Between the pulleys runs a belt, which consists of a set of metal elements held together by metal bands. In operation, the driving pulley pushes the belt to the driven pulley, thereby transferring power from the input to the output. The transmission drive ratio is controlled by opening or closing the moveable sheaves so that the belt rides lower or higher on the pulley faces. This manner of operation permits continuous adjustment of gear ratio between the input and output shafts. Other variations of CVTs employ a chain in place of the belt.

Various friction modifiers are known for use in transmissions. Published U.S. application US-2009-0312207-A, Dec. 17, 2009, Bartley et al., discloses a product of amines with hydroxy acid as friction modifiers suitable for automatic transmission fluids. An amide is disclosed represented by the formula $R^1R^2N—C(O)R^3$ wherein $R^1$ and $R^2$ are hydrocarbyl groups of at least 6 carbon atoms and $R^3$ is a hydroxyalkyl group of 1 to 6 carbon atoms or a group formed by the condensation of said hydroxyalkyl group.

U.S. Pat. No. 7,618,929, Nov. 17, 2009, Tipton et al., discloses secondary and tertiary amines as friction modifiers for automatic transmission fluids. A tertiary amine is disclosed, represented by the formula $R^1R^2NR^3$ wherein $R^1$ and $R^2$ are each independently an alkyl group of at least 6 carbon atoms and $R^3$ is a polyol-containing alkyl group. In one embodiment the amine is represented by $R^1R^2N—CH_2—CHOH—CH_2OH$.

Published U.S. application US-2005-0041395, Feb. 24, 2005, Tipton et al., discloses a multifunctional dispersant prepared by heating together (a) a dispersant and (b) 2,5-dimercapto-1,3,4-thiadiazole or a hydrocarbyl-substituted 2,5-dimercapto-1,3,4-thiadiazole which is substantially insoluble in a hydrocarbon oil of lubricating viscosity at 25° C., and further either (c) a borating agent or (d) an inorganic phosphorus compound, or both (c) and (d).

It has become clear from commercial use of CVTs that the fluids used in a CVT are just as important as the mechanical design for satisfactory operation. The lubricant must fulfill one or more of several functions: to lubricate the metal belt or chain in its contacts with the pulley assembly, the planetary and other gears, the wet-plate clutches, and the bearings; to cool the transmission; and to carry hydraulic signals and power. The lubricant must provide the appropriate degree of friction between the belt and pulley assembly, to avoid the problem of slippage on one hand, and binding on the other, all the while providing protection to the metal surfaces from pitting, scuffing, scratching, flaking, polishing, and other forms of wear. Accordingly, the fluid should maintain a relatively high coefficient of friction for metal/metal (typically, steel-steel) contact, as well as exhibiting a suitable degree of shear stability.

Thus, CVTs require fluids to provide a high metal-on-metal coefficient of friction in order to maintain acceptable clamping force between the pulley and the belt or chain. However, since CVTs typically also have either a torque converter clutch or a wet start clutch, a lower coefficient of friction is typically required in such elements in order to prevent shudder from occurring after high kilometer service (high mileage) accumulation in the field. A significant challenge is that high metal friction for the belt/pulley assembly and low wet clutch friction are opposing requirements. Prior art CVT fluids have typically been designed to provide good high metal friction, while sacrificing the wet clutch performance.

The present inventors have found a balanced combination of friction modifiers and multifunctional dispersants which maintains or improves the metal friction performance compared to current commercial CVT fluids, while showing improvement in anti-shudder durability.

SUMMARY OF THE INVENTION

The disclosed technology provides a lubricant composition comprising:

(a) an oil of lubricating viscosity (b) at least two nitrogen-containing materials, comprising at least one each of:

(i) at least one amide represented by the formula $$R^3C(O)NR^1R^2$$

wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent and (ii) at least one tertiary amine being represented by the formula $$R^4R^5NR^6$$

wherein $R^4$ and $R^5$ are each independently an alkyl group of at least 6 carbon atoms and $R^6$ is a polyhydroxyl-containing alkyl group or a polyhydroxyl-containing alkoxyalkyl group;

(c) a functionalized dispersant component, comprising one or more dispersants treated with (i) 2,5-dimercapto-1,3,4-thiadiazole or a hydrocarbyl-substituted 2,5-dimercapto-1,3,4-thiadiazole and (ii) a borating agent, and optionally (iii) a phosphorus compound, such as an inorganic phosphorus compound, and optionally (iv) an aromatic 1,3-dicarboxylic acid or 1,4-dicarboxylic acid, or a reactive equivalent thereof; and (d) at least one hydrocarbyl phosphite such as a dialkyl phosphite, which may, in certain embodiments, be present at at least 0.01 or at least 0.02 weight percent.

The disclosed technology further provides a method of lubricating a continuously variable transmission, comprising supplying thereto the composition set forth above.

DETAILED DESCRIPTION OF THE INVENTION

Various preferred features and embodiments will be described below by way of non-limiting illustration.

One component (a) of the disclosed technology is an oil of lubricating viscosity, also referred to as a base oil. The base oil may be selected from any of the base oils in Groups I-V of the American Petroleum Institute (API) Base Oil Interchangeability Guidelines, namely: Group I: >0.03% sulfur and/or <90% saturates and viscosity index 80 to 120; Group II: ≤0.03% S and ≥90% saturates and VI 80 to 120; Group III: ≤0.03% S and ≥90% saturates and VI>120; Group IV: all polyalphaolefins (PAOs); Group V: all others not included in Groups I, II, III or IV. Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used. In certain embodiments, Group III base oils are used, or more highly refined Group II oils (sometimes referred to as Group II+), either of the foregoing optionally in admixture with Group IV oils.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halo substituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from $C_5$ to $C_{12}$ monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined, and rerefined oils, either natural or synthetic (as well as mixtures thereof) of the types disclosed hereinabove can be used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The amount of the oil of lubricating viscosity present is typically the balance remaining after subtracting from 100 wt % the sum of the amount of the compound of the invention and the other performance additives. The lubricating composition may be in the form of a concentrate and/or a fully formulated lubricant. If the lubricating composition (comprising the additives disclosed herein) is in the form of a concentrate which may be combined with additional oil to form, in whole or in part, a finished lubricant, the ratio of the additives to the oil of lubricating viscosity and/or to diluent oil includes the ranges of 1:99 to 99:1 by weight, or 80:20 to 10:90 by weight.

Component (b)(i) is an amide (at least one amide), which can be viewed as the condensation product of a secondary amine with a hydroxy acid (described below), which can serve as a friction modifier. The amine component of the amide will contain two substituent hydrocarbyl groups, for example, alkyl groups and may be represented by the formula $$R^1R^2NH$$

In this formula, $R^1$ and $R^2$ are each independently a hydrocarbyl group of at least 6 carbon atoms (e.g., 6 to 30 carbon atoms or 8 to 20 carbon atoms or 10 to 18 or 12 to 16). The $R^1$ and $R^2$ groups may be linear or branched, saturated or unsaturated, aliphatic, aromatic, or mixed aliphatic and aromatic. In certain embodiments the R groups are alkyl groups and, in particular, linear alkyl groups. The $R^1$ and $R^2$ groups may be the same or different. A commercial example of a suitable amine is sold under the trade name Armeen 2C™. Certain amines are believed to have two $C_{1-2}$ alkyl groups. In one embodiment the amine comprises di-cocoalkylamine or homologous amines. Di-cocoalkylamine (or di-cocoamine) is a secondary amine in which the two R groups in the above formula are predominantly $C_{12}$ groups (although amounts of C8 through C18 are generally also present), derived from, derivable from, or characteristic of coconut oil. In certain embodiments, one both of the groups $R^1$ and $R^2$ may be 2-ethylhexyl groups. In one embodiment, the amine moiety $R^1R^2N$— of the amide comprises a (2-ethylhexyl)(hydrogenated tallow) amine moiety, where the "hydrogenated tallow" moiety refers to an alkyl group derived from, derivable from, or characteristic of tallow, having predominantly $C_{18}$ groups. It is understood that commercially available diamines will contain certain amounts of monoamines and/or triamines, and products formed from such commercial materials are contemplated to be within the scope of the present inventions (recognizing that any tertiary amine (or trialkyl amine) component would not be expected to be reactive to form an amide.)

The amide component (b)(i) of the present invention is typically a condensation product of the above-described amine with a hydroxy acid or a reactive equivalent thereof. The hydroxy acid can be represented by the formula $R^3COOH$, where $R^3$ is a hydroxyalkyl group of 1 to 6 carbon atoms or a group formed by the condensation of such hydroxyalkyl group, through the hydroxyl group thereof, with an acylating agent. (That is, the —OH group on $R^3$ is itself potentially reactive and may condense with additional acidic materials or their reactive equivalents to form, e.g., esters. Thus, the hydroxy acid may be condensed, for instance, with one or more additional molecules of acid such as glycolic acid.) An example of a suitable hydroxy acid is glycolic acid, that is, hydroxyacetic acid, HO—$CH_2$—COOH. Glycolic acid is readily commercially available, either in substantially neat form or as a 70% solution in water. When $R^3$ contains more than 1 carbon atom, the hydroxy group may be on the 1 carbon (α) or on another carbon in the chain (e.g., β or ω). The carbon chain itself may be linear, branched, or cyclic.

Suitable condensation products may thus include materials of the general structures $R^3C(O)—NR^1R^2$ and, when the acid is glycolic acid, such materials as

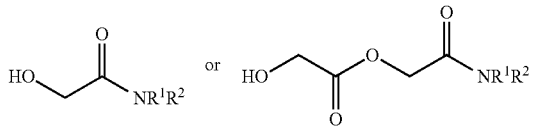

The amide of component (b)(i) is described in greater detail in published U.S. application US-2009-0312207. The amide component is believed to serve as a friction modifier, serving to provide, particularly when used in combination with component (b)(ii), performance benefits including anti-shudder durability to the steel-component interface contained within a wet clutch of a transmission.

The amount of the amide of component (b)(i) in the present lubricant composition may be 0.2 to 3 percent by weight, or 0.5 to 1.5 percent, or 0.75 to 1.25 percent, or 0.9 to 1.1 percent, or about 1 percent by weight. If more than one such amide is present, the total amount of all such amides may fall within such amounts.

Component (b)(ii) is a tertiary amine (at least one tertiary amine). The amine will contain three substituent hydrocarbyl groups, two of which are alkyl groups. The amine is represented by the formula $$R^4R^5NR^6$$

wherein $R^4$ and $R^5$ are each independently an alkyl group of at least 6 carbon atoms (e.g., 8 to 20 carbon atoms or 10 to 18 or 12 to 16) and $R^6$ is a polyhydroxyl-containing alkyl group or a polyhydroxyl-containing alkoxyalkyl group.

In one embodiment the amine comprises a product of di-cocoalkylamine or homologous amines. Di-cocoalkylamine (or di-cocoamine) (Aremeen 2C™) is a secondary amine in which two of the R groups in the above formula are predominantly $C_{12}$ groups and $C_{14}$ groups, derived from, derivable from, or characteristic of coconut oil, and the remaining R group is H. Such a secondary amine would be further reacted to form a tertiary amine, as described below.

In one embodiment, $R^6$ is a polyol-containing alkyl group (that is, a group containing 2 or more hydroxy groups). For instance, $R^6$ may be $—CH_2—CHOH—CH_2OH$ or a homologue thereof, containing, for example, 3 to 8 carbon atoms or 3 to 6 carbon atoms or 3 to 4 carbon atoms, and 2, 3, 4 or more hydroxy groups (normally no more than one hydroxy group per carbon atom). A typical resulting product may thus be represented by $$R^4R^5N—CH_2—CHOH—CH_2OH$$

or homologues thereof, where $R^4$ and $R^5$ are, as described above, independently alkyl groups of 8 to 20 carbon atoms. Such products may be obtained by the reaction of a dialkyl amine, described above, with an epoxide or chlorohydroxy compound. In particular, reaction of a secondary amine with glycidol (2,3-epoxy-1-propanol) or "chloroglycerine" (that is, 3-chloropropane-1,2-diol) may be effective. Such materials based on the reaction of dicocoamine with one or more moles of glycidol or chloroglycerine are particularly useful in providing useful products. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

The amine, component (b)(ii), may alternatively be described, in certain embodiments, as a compound comprising a core portion comprising 3 to 8 carbon atoms, (e.g, 3 to 6, or 3 carbon atoms), said core portion being substituted by: (i) at least two hydroxy groups, or at least one hydroxy group and at least one alkoxy group of 1 to 4 carbon atoms wherein said alkoxy group is further substituted by at least one hydroxy group or another such alkoxy group; and (ii) at least one amino group, the nitrogen atom thereof bearing two hydrocarbyl groups, each such hydrocarbyl group independently having 6 to 30 carbon atoms.

The amine of component (b)(ii) is disclosed in greater detail in U.S. Pat. No. 7,618,929. The amine is believed to serve as a friction modifier, serving to provide, particularly when used in combination with component (b)(i), performance benefits including anti-shudder durability to the steel-component interface contained within a wet clutch of a transmission.

The amount of the amine of component (b)(ii) in the present lubricant composition may be 0.03 to 0.5 percent by weight, or 0.05 to 0.3, or 0.05 to 0.15, or 0.08 to 0.1 weight percent. If more than one such amine is present, the total amount of all such amines may be within such amounts.

Another component of the present technology is a (c) dispersant component which has been treated to impart additional functionality, as described below. The dispersant component may comprise a plurality of molecules, some of which may be reacted with one or more of the functionalizing agents described below. The entire dispersant component, that is, all its molecules, may be treated with all of the desired functionalizing agents in a single reaction or sequence of reactions, or one portion of the dispersant component may be treated with one or more of the functionalizing agents and additional an portion or portions may be treated with one or more other functionalizing agents or with the same functionalizing agent in different relative amounts. The individually reacted dispersants may then be combined to provide the functionalized dispersant component. That is, not all of the functionalizing agents need to have reacted with each of the individual dispersants within the dispersant component. What is desired is that, within the overall dispersant component, there are dispersant molecules that have reacted (or otherwise interacted) with the functionalizing agents described below. In one embodiment, however, the dispersant molecules are reacted with all the desired functionalizing agents so that at least some, and, optionally, most of the dispersant molecules are reacted with all the functionalizing agents.

Dispersants in general are well known and include succinimide dispersants, Mannich dispersants, ester-containing dispersants, condensation products of a fatty hydrocarbyl monocarboxylic acylating agents with an amine or ammonia, alkyl amino phenol dispersants, hydrocarbyl-amine dispersants, polyether dispersants, polyetheramine dispersants, and viscosity modifiers containing dispersant functionality.

Succinimide dispersants and their methods of preparation are more fully described in U.S. Pat. Nos. 4,234,435 and 3,172,892. Succinimide dispersants are N-substituted long chain alkenyl succinimides, having a variety of chemical structures including typically

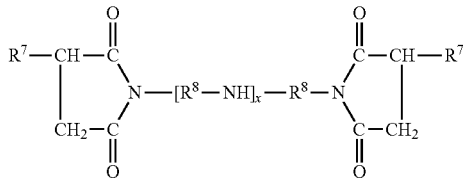

where each $R^7$ is independently a hydrocarbyl or alkyl group (which may be substituted by more than one succinimide group), frequently a polyisobutyl group with a molecular weight of 500-5000, and $R^8$ are alkylene groups, commonly ethylene ($C_2H_4$) groups. Such molecules are commonly derived from reaction of an alkenyl acylating agent with an amine, including monoamines, polyamines (illustrated in the formula above), and hydroxyamines. A wide variety of linkages between the two moieties is possible besides the simple imide structure shown above, including a variety of amides and quaternary ammonium salts; and the hydrocarbyl groups $R^7$ may be attached by a variety of structures, including cyclic linking structures.

The $R^7$ group in the above structure generally contains an average of at least 8, or 30, or 35 up to 350, or to 200, or to 100 carbon atoms. In one embodiment, the hydrocarbyl group is derived from a polyalkene characterized by an $\overline{M}_n$ (number average molecular weight) of at least 500. Generally, the polyalkene is characterized by an $\overline{M}_n$ of 500, or 700, or 800, or even 900 up to 5000, or to 2500, or to 2000, or even to 1500 or 1200. Polyolefins which can form the hydrocarbyl substituent can be prepared by polymerizing olefin monomers by well known polymerization methods, as described above, and are also commercially available. The olefin monomers include monoolefins, including monoolefins having 2 to 10 carbon atoms such as ethylene, propylene, 1-butene, isobutyl-ene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69%, in a second instance of 50 to 69%, and in a third instance of 50 to 95%. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The types of amines which may be used include monoamines, polyamines, alkanolamines, thiol-containing amines, and mixtures thereof. In order to be suitably reactive, the amine should contain at least one primary or secondary amine nitrogen atom, unless another reactive moiety, such as an OH group, is also present. The condensation product can be amide or imide, in the case of a monoamine or polyamine or an amide and/or ester and/or heterocyclic reaction product in the case of an alkanolamine. The amine can be a monoamine having one amine group and includes primary and secondary monoamines such as methylamine and dimethylamine. The monoamine can have 1 to 30 carbon atoms or 2 to 18 or 3 to 12 carbon atoms. Alternatively, the amine can be a polyamine having two or more amine groups where a first amine group is a primary amine group and a second amine group is a primary or secondary amine group. The reaction product of the monocarboxylic acylating agent and the polyamine can contain, in greater or lesser amounts depending on reaction conditions, a heterocyclic reaction product such as 2-imidazoline reaction products. The polyamine can have 2 to 30 carbon atoms. The polyamine can include alkylenediamines, N-alkyl alkylenediamines, and polyalkylenepolyamines. Useful polyamines include ethylene-diamine, 1,2-diaminopropane, N-methylethylenediamine, N-tallow($C_{16}$-$C_{18}$)-1,3-propylenediamine, N-oleyl-1,3-propylenediamine, polyethylenepolyamines such as diethylenetriamine and triethylenetetramine and tetraethylenepentamine and polyethylenepolyamine bottoms. The amine can also be an alkanolamine having at least one amine group and at least one hydroxyl group, where the amine group is a primary, secondary, or tertiary amine group. The alkanolamine can have 2 to 30 carbon atoms. The alkanolamine can include mono-, di- and trialkoxylates of ammonia such as mono- and di- and triethanolamine, hydroxy-containing monoamines such as a diethoxylated $C_{16}$ to $C_{18}$ tallowamine, and hydroxy-containing polyamines such as 2-(2-aminoethylamino)ethanol.

Another class of dispersant is ester-containing dispersants, which are typically high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Similarly, dispersants can be prepared by condensation of a hydrocarbyl acylating agent with both an amine and an alcohol, each as described above.

Mannich dispersants, another type of dispersants, are the reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms and may be derived from an olefin or a polyolefin. The aldehyde used to form the Mannich dispersant can have 1 to 10 carbon atoms, and is generally formaldehyde or a reactive equivalent thereof such as formalin or paraformaldehyde. The amine used to form the Mannich dispersant can be a monoamine or a polyamine, including alkanolamines, having one or more hydroxyl groups, as described in greater detail above. The Mannich dispersant can be prepared as described in U.S. Pat. No. 5,697,988.

The dispersant can also be a condensation product of a fatty hydrocarbyl monocarboxylic acylating agent, such as a fatty acid, with an amine, such as a polyamine, or ammonia. The hydrocarbyl portion of the fatty hydrocarbyl monocarboxylic acylating agent can be an aliphatic group. The aliphatic group can be linear, branched, or a mixture thereof and may be saturated, unsaturated, or a mixture thereof, having, for instance 1 to 50 carbon atoms, or 2 to 30 or 4 to 22 or 8, 10, or 12 to 20 carbon atoms. The monocarboxylic acylating agent can be a monocarboxylic acid or a reactive equivalent thereof, such as an anhydride, an ester, or an acid halide such as stearoyl chloride.

Alkyl amino phenol dispersants are hydrocarbyl-substituted aminophenols. The hydrocarbyl substituent of the aminophenol can have 10 to 400 carbon atoms, or 30 to 180 or 10 or 40 to 110 carbon atoms. The hydrocarbyl substituent can be derived from an olefin or a polyolefin, as described above. The hydrocarbyl-substituted aminophenol can have one or more amino groups.

Hydrocarbyl-amine dispersants are hydrocarbyl-substituted amines. The hydrocarbyl substituent of the amine can be the same as described above. In an embodiment of the invention the hydrocarbyl substituent of the hydrocarbyl-amine dispersant is a polyisobutylene having a number average molecular weight of 140 to 5600, or 420 to 2500, or 140 or 560 to 1540. The amine of component, which is substituted by the hydrocarbyl group, can be derived from ammonia, a monoamine, or a polyamine or alkanolamine as described above.

Polyether dispersants include polyetheramines, polyether amides, polyether carbamates, and polyether alcohols. Polyetheramines can be represented by the formula $R[OCH_2CH(R^1)]_nA$, where R is a hydrocarbyl group, $R^1$ is hydrogen or a hydrocarbyl group of 1 to 16 carbon atoms, or mixtures thereof, n is 2 to 50, and A can be $—OCH_2CH_2CH_2NR^2R^2$ or $—NR^3R^3$, where each $R^2$ is independently hydrogen or hydrocarbyl and each $R^3$ is independently hydrogen, hydrocarbyl, or an alkyleneamine group. Polyetheramines and their methods of preparation are described in greater detail in U.S. Pat. No. 6,458,172, columns 4 and 5.

Polymeric viscosity index modifiers (VMs) are also well known in the art, and many are commercially available. When dispersant functionality is incorporated onto the viscosity modifier, the resulting material is commonly referred to as a dispersant viscosity modifier. For example, a small amount of a nitrogen-containing monomer can be copolymerized with alkyl methacrylates, thereby imparting dispersancy properties into the product. Thus, such a product has the multiple functions of viscosity modification and dispersancy, and sometimes also pour point depressancy. Vinyl pyridine, N-vinyl pyrrolidone and N,N-dimethylaminoethyl methacrylate are examples of nitrogen-containing monomers which can be copolymerized with other monomers such as alkyl methacrylates to provide dispersant viscosity modifiers.

The dispersant component of the present technology will be functionalized by combining it, often with heating, together with one or more of the functionalizing agents described herein. Such functionalization is generally known from, for instance, published application US 2005-0041395. The exact chemical nature of the functionalized, or treated, dispersant component, after combination with the functionalizing agent, is not necessarily known. In particular, it is not known in every instance, nor is the scope of the present technology intended to depend on, whether the agent is attached to or associated with the dispersant by a covalent bond or an ionic bond or by some other means of association.

One functionalizing agent is a dimercaptothiadiazole compound or a derivative thereof. This material may be 2,5-dimercapto-1,3,4-thiadiazole or a monohydrocarbyl-substituted 2,5-dimercapto-1,3,4-thiadiazole. By this is meant that a hydrocarbyl substituent may replace an H atom of a mercapto group to form, e.g., a 2-hydrocarbyldithio-5-mercapto-1,3,4-thiadiazole; also, multiple sulfur atoms may be present in the linkage of the hydrocarbyl substituent to the thiadiazole nucleus. Such materials are well known. In some embodiments, the hydrocarbyl-substituted mercaptothiadiazoles used in the present technology (as well as the unsubstituted materials) may be substantially insoluble at 25° C. in non-polar media such as a hydrocarbon oil of lubricating viscosity. By "substantially insoluble" it is meant that such a dimercaptothiadiazole compound would typically dissolve to an extent of less than 0.1 weight percent, e.g., less than 0.01 or 0.005 weight percent, in oil at room temperature. A suitable hydrocarbon oil of lubricating viscosity in which the solubility may be evaluated is Chevron™ RLOP 100 N oil. The specified amount of the DMTD or substituted DMTD is mixed with the oil and the solubility can be evaluated by observing clarity versus the appearance of residual sediment after, e.g., one week of storage.

Thus, the total number of carbon atoms in the hydrocarbyl substituent or substituents, which tend to promote solubility, may, in such embodiments, be fewer than 8, or 6, or 4. In one embodiment, if there is a single substituent, the number of carbon atoms in that substituent may be 4 or fewer. If there are multiple hydrocarbyl substituents, each substituent may contain 4 or fewer or 3 or fewer carbon atoms.

The dispersant component is further treated with a borating agent. Borating agents include various forms of boric acid (including metaboric acid, $HBO_2$, orthoboric acid, $H_3BO_3$, and tetraboric acid, $H_2B_4O_7$), boric oxide, boron trioxide, and alkyl borates of the formula $(RO)_xB(OH)_y$ where x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally hydrated particulate metal borates, which are known in the art. Alkali metal borates include mixed alkali and alkaline metal borates. These metal borates are available commercially.

In some embodiments, the dispersant component is further treated with a phosphorus compound, which may be an inorganic phosphorus compound. The inorganic phosphorus compound may contain an oxygen atom and/or a sulfur atom as its constituent elements, and is typically a phosphorus acid or anhydride. This component includes the following examples: phosphorous acid, phosphoric acid, hypophosphoric acid, polyphosphoric acid, phosphorus trioxide, phosphorus tetroxide, phosphorus pentoxide ($P_2O_5$), phosphorotetrathioic acid ($H_3PS_4$), phosphoromonothioic acid ($H_3PO_3S$), phosphorodithioic acid ($H_3PO_2S_2$), phosphorotrithioic acid ($H_3PO_2S_3$), and $P_2S_5$. Among these, phosphorous acid and phosphoric acid or their anhydrides are preferred. A salt, such as an amine salt of an inorganic phosphorus compound can also be used. It is also possible to use a plurality of these inorganic phosphorus compounds together. The inorganic phosphorus compound is preferably phosphoric acid or phosphorous acid or their anhydride. It is possible, alternatively, to treat the dispersant component with an organic-containing phosphorus compound. In some embodiments, for instance, a phosphorus compound such as a dialkylphosphite (described in greater detail below) may be hydrolyzed or partially hydrolyzed in situ to form an inorganic phosphorus compound (e.g. phosphoric or phosphorous acid) or a phosphorus ester-acid. Such hydrolyzed or partially hydrolyzed material may react with the dispersant.

In some embodiments, the dispersant is further treated with an aromatic acid, in particular, an aromatic 1,3-dicarboxylic acid or 1,4-dicarboxylic acid, or a reactive equivalent thereof, or mixtures thereof. An example of such an acid is terephthalic acid. Such treated dispersants are disclosed, for example, in published application US 2009-005428. The term "a reactive equivalent thereof" includes acid halides, esters, amides, anhydrides, salts, partial salts, or mixtures thereof. The aromatic component of the aromatic acid is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the dispersant by salt formation or complexation, rather than formation of covalently bonded structures such as amides, which may also be formed but may play a less important role. Typically the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. Other ring substituents such as hydroxy or alkoxy (e.g., methoxy) groups may also be present in certain embodiments. In one embodiment the aromatic diacid is terephthalic acid.

The functionalized dispersant (or mixture of individual dispersants) may be prepared by reacted by heating the components thereof to form one dispersant or multiple dispersants that are combined to make the functionalized dispersant component. In certain embodiments, the borating agent and/or the phosphorus acid compound (if present) may be mixed and reacted (together or sequentially) with the remaining components, that is, with the dispersant, the dimercaptothiadiazole and with the dicarboxylic acid of an aromatic compound, if present, in an oil used as solvent or reaction medium. Other orders of reaction are possible. The heating will be at a sufficient time and temperature to assure solubility of resulting product in the reaction medium, typically 80-200° C., or 90-180° C., or 120-170° C., or 150-170° C. The time of reaction is typically at least 0.5 hours, for instance, 1-24 hours, 2-12 hours, 4-10 hours, or 6-8 hours. The length of time required for the reaction is determined in part by the temperature of the reaction, as will be apparent to one skilled in the art. Progress of the reaction may typically be evidenced by the evolution of $H_2S$ or water from the reaction mixture. Typically, the $H_2S$ is derived from one or more of the sulfur atoms in the dimercaptothiadiazole.

The reaction may be conducted in a hydrophobic medium such as an oil of lubricating viscosity which may, if desired, be retained in the final product. The oil, however, should preferably be an oil which does not itself react or decompose under conditions of the reaction. Thus, oils containing reactive ester functionality may be less suitable for use as the diluent. Oils of lubricating viscosity are described in greater detail above.

It is also possible that the functionalized dispersant component may comprise multiple individual dispersant species, as previously described, each of which may be reacted with different amounts or different types of functionalizing agent. In certain embodiments, for instance, one dispersant, or one portion of the total dispersant component, may be reacted with boric acid and terephthalic acid; another dispersant or portion of the total dispersant may be reacted with boric acid, terephthalic acid, and dimercaptothiadiazole. The total functionalized dispersant component then might be represented by the average amount of boron, terephthalic acid, and dimercaptothiadiazole present in the two or more individual species, plus the average amount of any phosphorus that may be present in the individual species. In one embodiment, the functionalized dispersant may be provided by a single dispersant species. In another embodiment, it may be provided by two or more species differing in some respect from each other. In one embodiment, the dispersant component comprises a dispersant species treated with boric acid and terephthalic acid and a dispersant species treated with boric acid, terephthalic acid, and 2,5-dimercapto-1,3,4-thiadiazole Any non-functionalized dispersant (not reacted with a borating agent or a dimercaptothiadiazole species) is not to be counted toward the total of the functionalized dispersant, but a non-functionalized dispersant may be present and considered a different component. It is recognized that, among all the molecules of a functionalized dispersant, there will be, statistically speaking, some molecules that have not reacted with the borating agent and/or the dimercaptothiadiazole species and/or other functionalizing agents. Those molecules are not discounted from the amount of functionalized dispersant.

The functionalized dispersant component overall may typically contain 0.4 to 1.5 weight percent sulfur derived from component the mercaptothiadiazole, or 0.6 to 1.2 weight percent, or 0.7 to 1.0 weight percent sulfur. It may likewise contain 0.4 to 1.2 or 0.6 to 1.0 weight percent boron from the borating agent. If it is further reacted with a phosphating agent, it may contain 0.3 to 1.1 percent phosphorus or 0.5 to 0.9 percent. If it is further reacted with an aromatic acid such as terephthalic acid, it may contain 0.01 to 0.3 or 0.02 to 0.15 or 0.04 to 0.10 weight percent reacted terephthalic acid moieties.

The relative amounts of the components which are reacted are, expressed as parts by weight prior to reaction are, in certain typical embodiments, 100 parts of the dispersant, per 0.0005 to 0.5 parts of the dicarboxylic acid of an aromatic compound, 0.1 to 6 parts of the dimercaptothiadiazole or substituted dimercaptothiadiazole, 1 to 7.5 parts of the borating agent and 0 to 7.5 parts of the phosphorus compound. In one embodiment the relative amount of the functionalizing materials is at least 1.5 parts per 100 parts of the dispersant component. In a one embodiment the relative amounts are 100 parts of dispersant component, 0.0005 to 0.1 aromatic dicarboxylic acid, 0.1 to 6 parts of the dimercaptothiadiazole component, 1 to 4.5 parts of the borating agent, and 0 to 4.5 or 1 to 4.5 parts of the phosphorus component. In another embodiment, the relative amounts are 100 parts dispersant: 0.0025 to 0.075 or 0.003 to 0.7 or 0.003 to 0.065 parts dicarboxylic acid: 0.1 to 5.0 parts or 0.15 to 3 or 0.2 to 2 or 0.3 to 1.3 or 0.8 to 1.2 parts dimercaptothiadiazole component: 3 to 7 or 4 to 6 or 3.5 to 7 or 3.5 to 5.5 parts borating agent: 0 to 4.4 parts or 0 to 3 or 0.5 to 3 parts phosphorus compound. The amounts and ranges of the various components may be independently combined—that is, for example, the amount of dicarboxylic acid may be selected to be 0.03 to 0.7 parts; and/or the amount of the dimercaptothiadiazole component may be selected to be 3.5 to 7 parts, independently of the amounts of the other components. Alternatively, each of the numerical values for parts by weight of the components may be expressed as percent by weight.

The amount of the functionalized dispersant component in the lubricant formulations of the present technology may be 2 to 5 weight percent, or 2.2 to 4 weight percent or 2.5 to 3.3 weight percent. In one embodiment, the functionalized dispersant component comprises 1.3 or 1.8 to 2.3 or 2.9 weight percent of a dispersant component functionalized with boric acid and terephthalic acid, but without a dimercaptothiadiazole component, and 0.4 or 0.6 to 1.5 to 1.8 weight percent of a dispersant component functionalized with boric acid and terephthalic acid and also functionalized with a dimercaptothiadiazole compound at a relatively higher treat concentration (about 1.2 percent) to provide a mixture of functionalized dispersants having the specified overall amount of dimercaptothiadiazole component.

The lubricant of the present technology also contains (d) a non-ionic phosphorus compound, in particular, a hydrocarbyl phosphite (also referred to as a hydrocarbyl hydrogen phosphonate or, sometimes, a hydrocarbyl phosphite). The hydrocarbyl phosphite includes those represented by the formula:

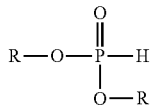

wherein each R may be independently hydrogen or a hydrocarbyl group, with the proviso that at least one of the R groups is hydrocarbyl. Each hydrocarbyl group of R may contain at least 2 or 4 carbon atoms. Typically, the combined total sum of carbon atoms present in both R groups may be less than 45, less than 35 or less than 25. Examples of suitable ranges for the total number of carbon atoms present in both R groups include 2 to 40, 3 to 24, 4 to 20, or 6 to 12. Examples of suitable hydrocarbyl groups include propyl, butyl, pentyl, hexyl dodecyl, butadecyl, hexadecyl, or octadecyl groups. Generally the hydrocarbyl phosphite is soluble or at least dispersible in oil. In one embodiment the hydrocarbyl phosphite may be a di-C3-C6 alkyl phosphite such as, in particular, dibutyl phosphite. The amount of the hydrocarbyl phosphite may be at least 0.1% by weight or at least 0.2% by weight, or greater than 0.2%, or at least 0.22%, or greater than 0.22%, or at least 0.24%, or greater than 0.24%, or at least 0.25%, or at least 0.26%, and up to 2% by weight or to 0.5% or to 0.4% or to 0.35%. In one embodiment its amount may thus be, for example, 0.26 to 0.35 percent by weight. A more detailed description of non-ionic phosphorus compounds is found in column 9, line 48 to column 11, line 8 of U.S. Pat. No. 6,103,673.

The lubricant of the present technology may also contain (e) a limited amount of one or more N,N-di(hydroxyethyl) fatty amines. This component may be present in amounts of 0 to 0.08 weight percent, or 0.01 to 0.08, or 0.02 to 0.05, or 0.01 to 0.04, or about 0.03 percent by weight, of a N,N-di (hydroxyethyl) fatty amine. An example of such an amine is known as Ethomeen™ T/12, available from AkzoNobel. This material, also known as N,N-di(hydroxyethyl)tallowalkylamine, may be represented by the formula $C_{18}$—N—$(C_2H_4OH)_2$, where $C_{18}$ represents the long chain alkyl groups, typically a mixture containing predominantly 18 carbon atoms, characteristic of tallowamine. The long chain or fatty carbon chain may contain at least 8 carbon atoms, e.g., 8 to 36, or 10 to 30, or 12 to 24, or 14 to 20, or 16 to 18 carbon atoms, or mixtures thereof.

Such fatty amine materials are typically included in automatic transmission fluids to improve the "break-in" characteristics of the fluid by conditioning the torque converter clutch of the transmission. Without such treatment, transmissions may exhibit "green shudder," that is, undesirable vibration during the initial operation of the transmission. However, the component is observed to significantly reduce the metal-metal friction coefficient, which is undesirable for the efficient functioning of a continuously variable transmission which relies on high, stable metal-metal friction. Therefore, the amount of this component should be within the low concentration ranges set forth above.

Given the "slippery" character of the N,N-di(hydroxyethyl) fatty amine, it is quite unexpected that materials of components (b)(i) and (b)(ii), which are similar in structure to an N,N-di(hydroxyethyl) fatty amine, may be used in relatively larger quantities without impairing the functioning of a continuously variable transmission. Indeed, the present compositions provide an unexpectedly high metal-metal coefficient of friction, as illustrated in the examples below.

Other materials may be included in the formulation to provide their known benefits. One such material is a detergent, of which one or more may be present. Detergents are typically overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Other overbased materials include salixarate detergents. These include overbased materials prepared from salicylic acid (which may be unsubstituted) with a hydrocarbyl-substituted phenol, such entities being linked through —$CH_2$— or other alkylene bridges. It is believed that the salixarate derivatives have a predominantly linear, rather than macrocyclic, structure, although both structures are intended to be encompassed by the term "salixarate." Salixarate derivatives and methods of their preparation are described in greater detail in U.S. Pat. No. 6,200,936 and PCT Publication WO 01/56968.

The amount of the detergent in the lubricant composition of the disclosed technology, if it is present, may be, for example, 0.1 to 2.0 weight percent, or 0.1 to 1 weight percent, or 0.2 to 0.6 weight percent. In certain embodiments, a calcium detergent, such as an overbased calcium detergent, may be present, and may provide calcium in the form of calcium ions (associated with the detergent or in the form of $CaCO_3$) in an amount of at least 300 parts per million by weight, or at least 500 or at least 1000 parts per million.

The lubricant composition may have a kinematic viscosity at 100° C. of up to about 12 $mm^2$/sec, for example, 2 to 10 or 6 to 8 $mm^2$/sec. Obtaining a lubricant with such viscosity will be within the skills of the person skilled in the art, by means of selection of a base stock and other components (such as viscosity modifier, described below) of suitable viscosity.

The lubricant composition may also contain dispersants other than functionalized dispersants. These materials are described in greater detail above, in connection with the description of the functionalized dispersants.

The compositions of the present invention may also contain a viscosity index modifier, for example, in limited amounts, that is, up to 15 percent by weight of the composition. In certain embodiments the amount of this component is 1 to 10 percent by weight, and other embodiments, 2 to 8 or 3 to 7 percent by weight.

Polymeric viscosity index modifiers (VMs) are extremely well known in the art and most are commercially available. Hydrocarbon VMs include polybutenes, poly(ethylene/propylene) copolymers, and hydrogenated polymers of styrene with butadiene or isoprene. Ester VMs include esters of styrene/maleic anhydride polymers, esters of styrene/maleic anhydride/acrylate terpolymers, and polymethacrylates. The acrylates are available from RohMax and from The Lubrizol Corporation; polybutenes from Afton Corporation and Lubrizol; ethylene/propylene copolymers from ExxonMobil and Afton; hydrogenated polystyrene/isoprene polymers from Shell; styrene/maleic esters from Lubrizol, and hydrogenated styrene/butadiene polymers from BASF.

Suitable VMs include acrylate- or methacrylate-containing copolymers or copolymers of styrene and an ester of an unsaturated carboxylic acid such as styrene/maleic ester (typically prepared by esterification of a styrene/maleic anhydride copolymer). Preferably the viscosity modifier is a polymethacrylate viscosity modifier. Polymethacrylate viscosity modifiers are prepared from mixtures of methacrylate monomers having different alkyl groups. The alkyl groups may be either straight chain or branched chain groups containing from 1 to 18 carbon atoms. When a small amount of a nitrogen-containing monomer is copolymerized with alkyl methacrylates, dispersancy properties are also incorporated into the product. Thus, such a product has the multiple functions of viscosity modification, pour point depressancy and dispersancy. Such products have been referred to in the art as dispersant-type viscosity modifiers or simply dispersant-viscosity modifiers. Vinyl pyridine, N-vinyl pyrrolidone and N,N-dimethyl-aminoethyl methacrylate are examples of nitrogen-containing monomers. Polyacrylates obtained from the polymerization or copolymerization of one or more alkyl acrylates also are useful as viscosity modifiers. It is preferred that the viscosity modifier of the present invention is a dispersant viscosity modifier.

The polymers described above may commonly have a weight average molecular weight ($\overline{M}_w$) of 1,000 or 2,000 or 10,000 up to 500,000, such as 30,000 to 250,000, or alternatively 20,000 to 100,000, and polydispersity values ($\overline{M}_w/\overline{M}_n$) of 1.2 to 5.

Another optional material that may be present are present invention is one or more friction modifiers, in addition to those described above. Friction modifiers include alkoxylated fatty amines, borated fatty epoxides, fatty phosphites (e.g., C16-18 alkyl phosphites), fatty epoxides, fatty amines, borated alkoxylated fatty amines, metal salts of fatty acids, fatty acid amides, glycerol esters, borated glycerol esters, fatty imidazolines, amine phosphate salts (e.g., salts of 2-ethylhexylamine), and salts of long chain alkyl phosphoric esters with long chain alkyl amines. "Fatty" materials are typically those that contain fatty alkyl groups, e.g., typically $C_8$ to $C_{22}$ alkyl groups, usually straight chain or sometimes mono-branched. The amount of such supplemental friction modifier, if present, will be an amount sufficiently small to not adversely affect the frictional performance provided by the above-enumerated components. Such amount may be 0.01 to 2 percent by weight of the fluid composition, or 0.05 to 1.2 percent, or 0.1 to 1 percent by weight.

The composition of the present invention may contain an inorganic phosphorus compound, typically in an amount of 0.005 to 0.3 percent by weight, preferably 0.02 or 0.03 or 0.04 percent to 0.2 or 0.16 or 0.13 percent (e.g., 0.02 to 0.2 percent by weight). The inorganic phosphorus compound may contain an oxygen atom and/or a sulfur atom as its constituent elements, and includes the followings examples: phosphorous acid, phosphoric acid, polyphosphoric acid, hypophosphoric acid, phosphorus trioxide, phosphorus tetroxide, phosphorous pentoxide, phosphorotetrathioic acid ($H_3PS_4$), phosphoromonothioic acid ($H_3PO_3S$), phosphorodithioic acid ($H_3PO_2S_2$), phosphorotrithioic acid ($H_3PO_2S_3$), and $P_2S_5$. Among these, phosphorous acid and phosphoric acid are suitable, the latter of which is conventionally supplied as 85% phosphoric acid (aqueous), for which the amount of phosphoric acid can be readily calculated. A salt, such as an amine salt of an inorganic phosphorus compound can also be used. It is also possible to use a plurality of these inorganic phosphorus compounds together.

The amount of the phosphorus containing compound or compounds in the fully formulated fluids of the present invention will typically be 0.01 to 6 percent by weight or 0.02 to 2 percent or 0.03 to 1 percent, or 0.04 to 0.7 percent by weight. Alternative amounts include 0.05 to 5 percent by weight, or 0.1 to 2 percent, or 0.2 to 1 percent by weight. The desired amount of such compounds will depend to some extent on the specific compound, its molecular weight, phosphorus content, and activity. Typically the fully formulated fluids of the present invention may contain 0.005 to 2, or 0.01 to 1, or 0.02 to 0.2, or 0.05 to 0.10, or 0.06 to 0.08 percent phosphorus from all sources.

Another material which may be present is a borate ester such as a trialkyl borate, which may be useful to as an extreme pressure/antiwear agent. The alkyl groups thereof may contain 4 to 12 carbon atoms, or 6 to 10 carbon atoms, or 8 carbon atoms. In one embodiment the trialkyl borate comprises tri(2-ethylhexyl) borate. The amount of the alkyl borate may be 0.1 to 1 weight percent or 0.2 to 0.7 weight percent or 0.3 to 0.4 weight percent.

Other conventional components such as antioxidants, seal swell agents, corrosion inhibitors, anti-foam agents, and dyes may be present in conventional amounts. In certain embodiments, molybdenum-containing additives such as molybdenum dithiocarbamates and titanium-containing additives may also be present to impart desirable properties such as antiwear performance, antioxidancy, and friction modification.

The various components which can be used in the present invention are described in greater detail in PCT Patent Application WO 00/70001. In one embodiment, the lubricant comprises at least one of an overbased detergent, a phosphorus compound, an antioxidant, a corrosion inhibitor, an anti-wear agent, a viscosity modifier, or mixtures thereof.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0137] to [0141] of published US application US 2010-0197536.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

A lubricant formulation is prepared containing the following components, listed in percent by weight (oil-free):

1.0—friction modifier, condensation product of dicocoamine and glycolic acid 0.08—friction modifier, 3-(N,N-dicocoamino)propane-1,2-diol 2.25—succinimide dispersant treated with boric acid, and terephthalic acid, 0.82 wt.

% B (terephthalic acid reacted at ratio of about 0.06 part per 100 parts dispersant 0.84—succinimide dispersant treated with boric acid, terephthalic acid, and dimercaptothiadiazole, 0.82% B, 0.82% S (terephthalic acid reacted at ratio as above)

0.03—N,N-di(hydroxyethyl)tallowalkylamine 0.12—borate ester friction modifier (borated long chain (C16) epoxide)

0.35—alkyl borate antiwear agent 0.41—overbased calcium detergents 0.08—phosphoric acid (85%)

0.3—dibutyl phosphite 0.12—di(long chain alkyl) phosphite 0.8—amine antioxidant 0.5—seal swell agent 0.12—corrosion inhibitors 0.2—pour point depressant 0.01—commercial foam inhibitors (including diluent)

about 10—polymethacrylate viscosity index modifier (oil-containing amount) (as needed to obtain desired viscosity index)

Balance to equal 100%—oils of lubricating viscosity

The above material (Example 1) is compared against two commercial CVT lubricant fluids (Ref. 1 and Ref. 2). Viscosity characteristic are measured by conventional means, to indicate that the fluid of the example is within acceptable performance.

The VT20 durability test is a full-scale laboratory test using a Van Doorne Transmissie VT20E "belt box" belt and pulley system for testing. The lubricant is maintained at 100° C. for each test. Testing is run in four stages under steady state conditions. Stage 1, "top," is run for 40 hours at an input speed of 6000 rpm and an input speed:output speed ratio of 0.617. Stage 2, "overdrive," is run for 40 hours at an input speed of 4000 rpm and ratio of 0.437. Stages 3 and 4 (low) are run for 15 and 20 hours, respectively, at 4000 rpm and ratio 2.61. The coefficient of friction is calculated from torque capacity measurements at each ratio. Further details are provided in SAE publication 2003-01-3253, Pennings et al., "Van Doorne CVT Fluid Test: A Test Method on Belt-Pulley Level to Select Fluids for Push Belt CVT Applications."

The JASO (Japanese Automobile Standard) M349 anti-shudder durability test involves determining the durability of the test lubricant for a startup clutch. Friction characteristics are plotted in terms of $d\mu/dV$ as a function of time. Retention of values greater than zero for longer periods of time indicate better endurance of the fluid (resistance to shudder)

Results are shown in the following table:

| | Ref 1 | Ref 2 | Example 1 |
|---|---|---|---|
| Viscosity characteristics | | | |
| Kinematic viscosity, 100° C. ($mm^2/s$) | 7.22 | 7.26 | 5.36 |
| Kinematic viscosity, 40° C. | 33.7 | 31.7 | 24.3 |
| Viscosity index | 186 | 205 | 163 |
| Brookfield viscosity, −40° C. | 9460 | 9640 | 6270 |
| VT20 Durability Test | | | |
| Coefficient of Friction - Top ratio | 0.0976 | 0.0996 | 0.1027 |
| Overdrive ratio | 0.0961 | 0.0976 | 0.0962 |
| Low ratio | 0.0810 | 0.0810 | 0.0899 |
| Anti-shudder durability, JASO LVFA M349 | | | |
| Hours to Shudder (negative slope) | 96 | 144 | 552 |

The tests show that the fluid of Example 1 has as good or somewhat better (higher) coefficients of friction as compared with the reference lubricants. The coefficient of friction is especially improved under the "low ratio" condition, which is particularly demanding. The fluid also exhibits much improved anti-shudder durability. It is observed that several minor variations of the formulation of Example 1 will typically provide at least 400 hours to shudder, much improved compared to the reference materials.

Thus, a high and stable metal-metal (steel-steel) coefficient of friction, required for CVT lubricating, can be obtained by the formulations of the present technology, including in particular the present functionalized dispersant component. Moreover, the present technology can improve anti-shudder and friction durability of wet clutches without negative impact on metal friction performance. Moreover, good wear protection of the metal contact surfaces is achievable.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity (b) at least two nitrogen-containing materials, comprising at least one each of:

(i) about 0.2 to about 3 percent by weight of at least one amide represented by the formula $$R^3C(O)NR^1R^2$$

wherein $R^1$ and $R^2$ are each independently hydrocarbyl groups of at least 6 carbon atoms and $R^3$ is a hydroxyalkyl group of 1 to 6 carbon atoms or a group formed by the condensation of said hydroxyalkyl group, through a hydroxyl group thereof, with an acylating agent and (ii) about 0.03 to about 0.5 percent by weight of at least one tertiary amine represented by the formula $$R^4R^5NR^6$$

wherein $R^4$ and $R^5$ are each independently alkyl groups of at least 6 carbon atoms and $R^6$ is a polyhydroxy-containing alkyl group or a polyhydroxy-containing alkoxyalkyl group;

(c) about 2 to about 5 percent by weight of a functionalized dispersant component, comprising one or more dispersants, treated with (i) 2,5-dimercapto-1,3,4-thiadiazole or hydrocarbyl-substituted 2,5-dimercapto-1,3,4-thiadiazole and (ii) a borating agent, and optionally (iii) an inorganic phosphorus compound, and optionally (iv) an aromatic 1,3-dicarboxylic acid or 1,4-dicarboxylic acid, or a reactive equivalent thereof;

(d) about 0.22 to about 2 weight percent of at least one di-C3-C6 alkyl phosphite; and (e) about 0.1 to about 1 weight percent of a trialkyl borate, the alkyl groups of which each contain about 4 to about 12 carbon atoms.

2. The lubricant composition of claim 1, further containing (f) 0.01 to about 0.08 percent by weight of a N,N-di (hydroxyethyl) fatty amine.

3. The composition of claim 1 wherein the amide of (b)(i) comprises a condensation product of glycolic acid with a secondary amine $R^1R^2NH$ in which $R^1$ and $R^2$ each independently contain about 8 to about 20 carbon atoms.

4. The composition of claim 1 wherein, in component (b)(i), $R^1$ is 2-ethylhexyl, or mixed alkyl groups comprising a C12 alkyl group, or mixed alkyl groups comprising a C18 alkyl group, and $R^2$ is mixed alkyl groups comprising a C12 alkyl group or mixed alkyl groups comprising a C18 alkyl group.

5. The composition of claim 1 wherein the amine of (b)(ii) is represented by the formula $R^4R^5N—CH_2—CHOH—CH_2OH$, wherein $R^4$ and $R^5$ are each independently alkyl groups containing about 8 to about 20 carbon atoms.

6. The composition of claim 1 wherein, in the amine of (b)(ii), $R^4$ and $R^5$ each comprise C12 alkyl groups.

7. The composition of claim 1 wherein the dispersant of (c) comprises at least one succinimide dispersant.

8. The composition of claim 1 wherein said dispersant component (c) is treated with about 0.15 to about 3 weight percent 2,5-dimercapto-1,3,4-thiadiazole.

9. The composition of claim 1 wherein said dispersant component (c) contains about 0.4 to about 1.2 percent by weight boron from the borating agent.

10. The composition of claim 1 wherein the borating agent of comprises boric acid.

11. The composition of claim 1 wherein the dispersant component (c) is treated with about 0.003 to about 0.07 weight percent of an aromatic 1,3-dicarboxylic acid or 1,4-dicarboxylic acid, said acid comprising terephthalic acid.

12. The composition of claim 1 wherein the dispersant component comprises a first dispersant species treated with boric acid and terephthalic acid and a second dispersant species treated with boric acid, terephthalic acid, and dimercaptothiadiazole.

13. The composition of claim 1 wherein the dialkyl phosphite of component (d) comprises dibutyl phosphite.

14. The composition of claim 2 wherein the N,N-di (hydroxylethyl) fatty amine of component (f) comprises N,N-di(hydroxyethyl)tallowalkylamine.

15. The composition of claim 2 wherein the N,N-di (hydroxyethyl) fatty amine is present in an amount of about 0.01 to about 0.08 percent by weight.

16. The composition of claim 1 further comprising at least one of an overbased detergent, an additional phosphorus compound, an antioxidant, a corrosion inhibitor, an anti-wear agent, a viscosity modifier, or mixtures thereof.

17. The composition of claim 1 wherein the composition comprises a calcium detergent and wherein the composition contains at least about 300 parts per million by weight of calcium.

18. A method of lubricating a continuously variable transmission, comprising supplying thereto the composition of claim 1.

19. The method of claim 18 wherein the continuously variable transmission comprises lubricated metal-metal contact drive elements.

20. The method of claim 18 wherein the continuously variable transmission comprises a metal belt or a metal chain in lubricated contact with a metal pulley.

21. The composition of claim 1 further comprising about 0.05 to about 1 percent by weight of a C8-22 alkyl phosphite.

22. A lubricant composition comprising:

(a) an oil lubricating viscosity (b) at least two nitrogen-containing materials, comprising at least one each of:

(i) about 0.5 to about 1.25 percent by weight of at least one amide being the condensation product of a dialkylamine, wherein the alkyl groups each independently contain about 8 to about 20 carbon atoms, and glycolic acid and (ii) about 0.05 to about 0.3 percent by weight of at least one tertiary amine represented by the formula $$R^4R^5N–CH_2–CHOH–CH_2OH$$

wherein $R^4$ and $R^5$ are each independently alkyl groups of at about 8 to about 20 carbon atoms;

about 2 to about 4 percent by weight of a functionalized succinimide dispersant component, comprising one or more dispersants, treated with (i) 2,5-dimercapto-1,3,4-thiadiazole and (ii) a borating agent;

(d) about 0.2 to about 0.4 weight percent of dibutyl phosphite; and (e) about 0.2 to about 0.7 weight percent of a trialkyl borate, the alkyl groups of which each contain about 6 to about 10 carbon atoms.

* * * * *